US009683321B2

(12) United States Patent
Lonati et al.

(10) Patent No.: US 9,683,321 B2
(45) Date of Patent: Jun. 20, 2017

(54) CIRCULAR KNITTING MACHINE

(71) Applicant: SANTONI S.P.A., Brescia (IT)

(72) Inventors: Tiberio Lonati, Brescia (IT); Fausto Lonati, Brescia (IT); Ettore Lonati, Botticino (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 14/916,620

(22) PCT Filed: Sep. 26, 2014

(86) PCT No.: PCT/IB2014/064869
§ 371 (c)(1),
(2) Date: Mar. 4, 2016

(87) PCT Pub. No.: WO2015/049621
PCT Pub. Date: Apr. 9, 2015

(65) Prior Publication Data

US 2016/0215419 A1 Jul. 28, 2016

(30) Foreign Application Priority Data

Oct. 2, 2013 (IT) ..... BS2013A0137

(51) Int. Cl.
*D04B 15/99* (2006.01)
*D04B 15/32* (2006.01)
(Continued)

(52) U.S. Cl.
CPC ..... *D04B 15/99* (2013.01); *D04B 15/32* (2013.01); *D04B 15/322* (2013.01); *D04B 15/54* (2013.01); *D04B 15/58* (2013.01)

(58) Field of Classification Search
CPC ..... D04B 5/54; D04B 15/32; D04B 15/99
See application file for complete search history.

(56) References Cited

U.S. PATENT DOCUMENTS 2,919,566 A * 1/1960 Felker ..... D04B 35/32 15/304
3,177,686 A * 4/1965 Croucher ..... D04B 15/68 66/8

(Continued)

FOREIGN PATENT DOCUMENTS

CN 1222946 A 7/1999
CN 101970737 A 2/2011

(Continued)

*Primary Examiner* — Danny Worrell
(74) *Attorney, Agent, or Firm* — Pearne & Gordon LLP

(57) ABSTRACT

A circular knitting machine (1) for knitwear or hosiery, comprising a bearing structure (2), a needle cylinder (C), a plurality of needles and a plurality of thread feeding points, or feeders (3), positioned circumferentially about the needle cylinder, in which the thread is supplied to the needles. Each feeder is provided with at least a thread guide group (4), comprising a body (5), a pneumatic supply inlet (6), a plurality of feeders, a plurality of pneumatic actuators able to move the feeders, and a plurality of solenoid valves (8) mounted and connected directly to the body (5), wherein each solenoid valve activate or deactivates the pneumatic supply to a respective pneumatic actuator of the thread guide group. Each feeder further comprises a mobile cam device (10) for command of the needles, comprising a body (11), a pneumatic supply inlet (12), one or more mobile command cams (13) able to interact with the needles, a plurality of pneumatic actuators which move the command cams, and a plurality of solenoid valves (14) mounted and connected directly to the body (11), wherein each solenoid valve activates or deactivates the pneumatic supply to a respective pneumatic actuator of the device (10). Each feeder comprises an electronic feeder command board (20), able to command at least the solenoid valves (8) of the thread guide group (4) and the solenoid valves (14) of the mobile cam device (10), with the aim of selectively activating the (Continued)

pneumatic actuators of the thread guide group and the mobile cam device (10). The knitting machine (1) comprises at least a pneumatic supply pathway able to supply the pneumatic actuators of the plurality of feeders (3) of the machine.

10 Claims, 10 Drawing Sheets

(51) Int. Cl.
*D04B 15/54* (2006.01)
*D04B 15/58* (2006.01)

(56) References Cited

U.S. PATENT DOCUMENTS 3,587,251 A * 6/1971 Vincoli ..... D04B 15/66 184/6
3,683,644 A * 8/1972 Chvala ..... D04B 15/78 66/40
3,793,850 A * 2/1974 Wills-Moren ..... D04B 15/78 66/222
3,890,809 A * 6/1975 Tenconi ..... D04B 15/60 66/132 R
4,492,097 A * 1/1985 Ferraris ..... D04B 15/24 66/108 R
5,187,951 A 2/1993 Stroud et al.
5,222,380 A 6/1993 Lonati et al.
6,044,668 A 4/2000 Conti
7,954,343 B2 6/2011 Lonati et al.
2010/0313607 A1 12/2010 Lonati et al.
2016/0122914 A1 * 5/2016 Lonati ..... D04B 15/60 66/145 R
2016/0130735 A1 * 5/2016 Lonati ..... D04B 15/38 66/145 R

FOREIGN PATENT DOCUMENTS

CN 202214565 U 5/2012
WO 2006075380 A1 7/2006

* cited by examiner

CIRCULAR KNITTING MACHINE

The present invention relates to a circular knitting machine. In particular, the invention relates to a circular knitting machine characterised by a specific structure of the feeders of the machine and a specific configuration of the part of pneumatic supply of the devices comprised in the feeders. The present invention further relates to a method for pneumatic supply of the feeders of a circular knitting machine.

The present invention relates to the technical sector of circular knitting machines, seamless type machines, hosiery machines and the like.

In the present description, the term "knitting machine" is meant in general to relate to a circular knitting machine for production of textile articles and provided with a plurality of thread feeding points, or "feeders", in which the thread is supplied to the needles of the machine. The knitting machine can be for example of a single-bed or a double-bed type. Circular knitting machines can comprise a variable number of feeders, for example 2, 4, 6, 8 or more.

In the sector of circular knitting machines various types of realisation of the single feeder and the devices connected thereto are known. In general, each feeder usually comprises at least one device for supplying thread to the plurality of needles, known as the thread guide group, which comprises a plurality of thread supply organs, or thread guides, arranged laterally of the feeder organs, or thread guides, arranged laterally of the needle-bearing organ at the respective feeder, and a plurality of pneumatic actuators able to move the thread guides in a controlled way. Typically each feeder further comprises a mobile cam device for controlling the needles of the needle-bearing organ, provided with one or more command cams able to interact with the needles and a plurality of pneumatic actuators which controlledly move the command cams. Each feeder typically also comprises a respective stitch regulating cam, known in the sector as a stitch cam, active on the needles and vertically mobile, by means of a respective actuator (usually a step motor) such as to vary the size of the stitches produced by the needles at the respective feeder.

Lastly, each feeder is usually also provided with a needle selecting device, like a drum, equipped with a plurality of actuators (typically of the piezoelectric type) which act individually on a plurality of selectors—or "undern-eedles"—each located below a respective needle of the cylinder of the knitting machine. Each actuator moves the respective selector so that it positions the respective needle in various operating configurations, with the aim of carrying out a determined knitting pattern.

In substance, each feeder internally contains a grouping of respective devices (thread guide group, mobile cam device, stitch regulating cam and needle-selecting device). This structure is repeated for each feeder, in a modular design internally of the knitting machine.

The known knitting machines are further provided with a command board (or central unit) which comprises the electronic components able to govern the functioning of the whole knitting machine, i.e. to manage the rotation of the needle cylinder and the functioning of the devices comprised in all the feeders. In particular, the command board must be able to singly command all the devices present in the various feeders: for this purpose it comprises electronic boards for managing (for each feeder) the electrical components, for example the motor of the stitch regulating cam and the needle selecting device, and a plurality of solenoid valves for commanding all the pneumatic actuators which move the thread guides of the thread guide group and the command cams of the mobile cam devices. In practice, a respective solenoid valve is associated to each pneumatic actuator present in the knitting machine, which manages the pneumatic supply enabling activation of the corresponding pneumatic actuator.

To complete the pneumatic supply and control functions, the known knitting machines further comprise a complex group of connections between the command board and the feeders. In fact, each feeder must be connected electrically and electronically with the command board in order to receive therefrom all the necessary commands for its functioning (the activating of the cam motor, the control of the selecting device, etc.), for receiving the electric supply, and for sending to the command board control signals on the state of the feeder and its devices. For this purpose, the knitting machine comprises a set of connections which start from the command board and singly reach all the devices of all the feeders; in other words, for each feeder there is an electric cable between the command board and the thread guide group, an electric cable between the command board and the mobile cam device, an electric cable between the command board and the stitch regulating cam, etc. In this way each device of each feeder is controllable by the command board.

In addition to the electric part of connection between the feeders and the command board, each feeder must be connected also pneumatically with the respective solenoid valves located in the command board. In fact, a pneumatic tube branches from each solenoid valve present in the command board, which tube is singly attached to a respective pneumatic actuator that is a part of a particular device of a particular feeder. In practice, a plurality of pneumatic tubes supplies compressed air to all the pneumatic actuators of the thread guide groups and the mobile cam devices of each feeder, connecting them with the central unit. The command board, acting on each solenoid valve, is able to command, as required, a sending of a flow of compressed air and therefore the activating of each pneumatic actuator, and consequently to controlledly move each thread guide and each needle command cam. A source of compressed air is present in the command board of the knitting machine, from which the solenoid valves source compressed air to supply the respective pneumatic tube leading to the respective pneumatic actuator. The Applicant has found that the known knitting machines are not without drawbacks and can be improved in various ways, in particular with reference to the structural complexity thereof and the management of the single feeders.

A drawback typical of the known solutions is represented by the fact that as described above it is necessary to predispose a plurality of electric cables and pneumatic supply tubes which extend internally of the machine so as to connect the feeders to the processing board.

Overall the number of pneumatic connections can be very high: each single pneumatic actuator requires a tube for the compressed air, and each feeder can comprise tens of pneumatic actuators. Each pneumatic tube must be connected to the command board, where the solenoid valves are located.

The number of electric connections is also very high: each feeder requires a plurality of electric cables enabling the command board to manage the functioning of its devices.

The large number of pneumatic connections creates a series of drawbacks:

- it makes the pneumatic cabling operations of the machine complex and difficult;

it increases the cost of the knitting machine;

it increases the time required for manufacturing the knitting machine;

it can lead to errors in the cabling and mounting of the machine;

it makes the detecting of faults and/or malfunctioning difficult, and in general complicates the operations of maintenance of the knitting machine;

it increases the probability of faults and malfunctioning, as a large number of tubes are present positioned in an environment subjected to vibrations, oil, dust, etc;

it complicates the overall structure of the machine, which is occupied by a plurality of pneumatic tubes;

it makes the structure and the programming of the command board complex, as it has to manage a very high number of pneumatic connections.

A further drawback of known knitting machines is the slow speed of the commands, as the pneumatic actuators of the dial group are supplied via pneumatic tubes singly connected to the command board, in which the respective command solenoid valve is located: the pneumatic groups of the feeders being at a greater distance from the command board introduces a delay in the activation of the pneumatic actuators with respect to the instant at which the respective solenoid valves are activated. This reduces the activating velocity of the organs of the dial group, and overall limits the performance obtainable by the knitting machine.

In this situation the aim underpinning the present invention, in its various aspects and/or embodiments, is to disclose a circular knitting machine which is able to obviate one or more of the cited drawbacks.

A further aim of the present invention is to provide a knitting machine characterised by a small number of pneumatic and electrical connections destined to the feeders, in particular with respect to the known solutions.

A further aim of the present invention is to disclose a knitting machine characterised by mounting times, in particular pneumatic cabling times, that are faster than with the known solutions.

A further aim of the present invention is to provide a knitting machine able to reduce the possibility of mounting errors.

A further aim of the present invention is to disclose a knitting machine characterised by high reliability of functioning and/or by a smaller predisposition to faults and malfunctioning.

A further aim of the present invention is to disclose a knitting machine characterised by a high degree of facility in the maintenance operations.

A further aim of the present invention is to disclose a knitting machine characterised by a simple and rational structure.

A further aim of the present invention is to disclose a knitting machine able to afford a more efficient and effective control of the single feeders and the devices thereof.

A further aim of the present invention is to provide a knitting machine characterised by a versatile control of the single feeders, so as to be easily adaptable to the various production requirements.

A further aim of the present invention is to disclose a knitting machine able to activate the devices of the feeders with greater velocity and precision with respect to the known knitting machines.

A further aim of the invention is to provide a knitting machine with improved performance, in particular able to improve the control and increase productivity, for example in terms of quantity of knitting produced by the time unit and/or the complexity of the knitting produced.

A further aim of the present invention is to disclose a knitting machine characterised by a production cost that is modest with respect to the performance and quality provided.

These aims and others besides, which will more fully emerge during the course of the following description, are substantially attained by a circular knitting machine and/or by a method for pneumatically supplying and controlling the feeders of a circular knitting machine, according to one or more of the appended claims, each of which taken alone (without the relative dependencies) or in any combination with the other claims, as well as according to the following aspects and/or embodiments, variously combined also with the above-mentioned claims.

In a first aspect, the invention relates to a circular knitting machine for knitwear or hosiery, comprising:

a bearing structure;

at least a needle-bearing organ or needle cylinder rotatably mounted in the bearing structure;

a plurality of needles supported by the needle cylinder and mobile parallel to a rotation axis of the needle cylinder so as to produce a knitted fabric;

a plurality of thread feeding points, or feeders, wherein the thread is supplied to the needles of the machine, the feeders being positioned circumferentially about the needle-bearing organ and distanced angularly to one another.

In an aspect each feeder comprises at least:

a device for feeding thread to the plurality of needles, or "thread guide group", comprising a body of the thread guide group, an inlet for pneumatic supply, i.e. a flow of compressed air, a plurality of thread feeding organs, or "thread guides", arranged laterally to the needle-bearing organ at the respective feeder, and a plurality of pneumatic actuators movably housed in the body of the thread guide group and configured so as to controlledly move the plurality of thread guides, the thread guide group comprising a plurality of solenoid valves mounted and connected directly to the body of the thread guide group, each solenoid valve being configured and predisposed to activate or deactivate the pneumatic supply to a respective pneumatic actuator of the thread guide group, with the aim of selectively actuating the respective actuator;

a mobile cam device for control of the needles, comprising a respective body of the mobile cam device, a respective pneumatic supply inlet, i.e. a flow of compressed air, one or more command cams movably mounted to the body and able to interact with the needles, and a respective plurality of pneumatic actuators movably housed in the body and configured to controlledly move the one or more command cams, the mobile cam device comprising a respective plurality of solenoid valves mounted and connected directly to the body of the mobile cam device, each solenoid valve being configured and predisposed to activate or deactivate the pneumatic supply of a respective pneumatic actuator of the device, with the aim of selectively actuating the respective actuator.

In an aspect each feeder further comprises an electronic feeder command board, for example located on the thread guide group, configured and predisposed to command at least the solenoid valves of the thread guide group and the solenoid valves of the mobile cam device, with the aim of selectively actuating the pneumatic actuators of the thread guide group and the pneumatic actuators of the mobile cam device.

In an aspect the knitting machine further comprises at least a pneumatic supply pathway able to supply the pneumatic actuators of the plurality of feeders of the machine.

In an aspect the machine comprises exactly a single serial pneumatic supply pathway developing annularly about the rotation axis of the cylinder, the single pneumatic supply pathway comprising a pneumatic conduit or a sequence of sections of pneumatic conduit connecting, in series, all the feeders of the knitting machine, in such a way that along the pneumatic supply pathway each feeder is pneumatically connected to the preceding feeder and with the following feeder.

In an aspect the sequence of sections of conduit of the single pneumatic supply pathway of the knitting machine comprises a plurality of connecting conduits between distinct feeders and a plurality of internal conduits in each feeder, arranged in series that are alternated with one another.

In an aspect each connecting conduit is interposed and shared, between two adjacent feeders, connecting a pneumatic supply outlet of the thread guide group of a preceding feeder with the pneumatic supply inlet of the mobile cam device of the following feeder, or vice versa, connecting a pneumatic supply outlet of the mobile cam device of a preceding feeder with the respective pneumatic supply inlet of the thread guide group of the successive feeder.

In an aspect each internal conduit connects a pneumatic supply outlet of the mobile cam device of a respective feeder with the respective pneumatic supply inlet of the thread guide group of the same feeder, or vice versa each internal conduit connects a pneumatic supply outlet of the thread guide group of a respective feeder with the respective pneumatic supply inlet of the mobile cam device of the same feeder.

In an aspect, the pneumatic conduit or the sequence of sections of pneumatic conduit connect, in series with one another, all the thread guide groups of the feeders and the sequence of sections of the single pneumatic supply pathway of the machine further comprises a plurality of branching conduits internal of each feeder and each connecting a secondary pneumatic supply outlet of the thread guide group of a respective feeder with the respective pneumatic supply inlet of the mobile cam device of the same feeder, or vice versa the pneumatic conduit or the sequence of sections of pneumatic conduit connect in series all the mobile cam devices of the feeders and wherein the sequence of sections of the single pneumatic supply pathway of the machine further comprises a plurality of branch conduits internal of each feeder and connecting a secondary pneumatic supply outlet of the mobile cam device of a respective feeder with the respective pneumatic supply inlet of the thread guide group of the same feeder.

In an aspect the electronic command board of each feeder is configured and predisposed to command all of the solenoid valves present internally of the feeder, with the aim of selectively actuating all the pneumatic actuators of the feeder.

In an aspect the knitting machine comprises a first serial pneumatic supply pathway, developing annularly about the rotation axis of the cylinder, comprising a pneumatic conduit or a sequence of sections of pneumatic conduit connecting, in series, the thread guide groups of all the feeders of the knitting machine, in such a way that along the first pneumatic supply pathway each thread guide group is pneumatically connected with the preceding thread guide group and with the successive thread guide group.

In an aspect the knitting machine comprises a second serial pneumatic supply pathway, developing annularly about the rotation axis of the cylinder, comprising a respective pneumatic conduit or a respective sequence of sections of pneumatic conduit connecting, in series, the mobile cam devices of all the feeders of the knitting machine, in such a way that along the second pneumatic supply pathway each mobile cam device is pneumatically connected with the preceding mobile cam device and with the successive mobile cam device.

In an aspect at least a feeder of the knitting machine is provided with an auxiliary pneumatic device group, comprising a pneumatic actuator for moving a position sensor of the tongues and/or a pneumatic actuator for moving a needle-broken detector and/or a pneumatic for commanding the opening of the needles and/or a pneumatic actuator for commanding the sponge plate cams, the auxiliary pneumatic devices group comprising a respective pneumatic supply inlet, i.e. a compressed air flow, one or more pneumatic actuators configured to controlledly move one or more of the auxiliary pneumatic devices and one or more solenoid valves mounted directly or connected to the auxiliary devices, each solenoid valve being configured and predisposed to activate or deactivate the pneumatic supply to a respective pneumatic actuator of the auxiliary pneumatic devices group, with the aim of selectively activating the respective actuator.

In an aspect the single pneumatic supply pathway comprises a plurality of internal conduits connecting for each feeder the supply outlet of the supply to the respective thread guide group, or the supply outlet of the respective mobile cam device, with a supply inlet of the auxiliary pneumatic device group.

In an aspect the knitting machine comprises a third serial pneumatic supply pathway, developing annularly about the rotation axis of the cylinder and comprising a respective pneumatic conduit or a respective sequence of pneumatic conduit sections connecting, in series, the groups of auxiliary pneumatic devices of all the feeders of the knitting machine, so that along the third pneumatic supply pathway each group of auxiliary pneumatic devices is connected pneumatically with the preceding auxiliary pneumatic devices group and the following auxiliary pneumatic devices group.

In an aspect the knitting machine comprises a plurality of pneumatic supply pathways for the feeders, in a reciprocally parallel arrangement, equal in number to the plurality of feeders of the machine, each pneumatic supply pathway to the feeder being configured and predisposed to receive a compressed air flow from a source of compressed air of the machine and to supply, with the compressed air flow, the pneumatic actuators present internally of a respective feeder.

In an aspect each pneumatic supply pathway to the feeders comprises a connecting conduit connecting the compressed air source with the pneumatic supply inlet of the thread guide group of the respective feeder supplied by the supply pathway, and at least an conduit internal of the feeder, connecting a pneumatic outlet of the thread guide group with the pneumatic supply inlet of the mobile cam device of the feeder. Alternatively, the respective connecting conduit of each pathway of pneumatic supply to the feeders connects the source of compressed air with the pneumatic supply inlet of the mobile cam device of the respective feeder supplied by the supply pathway, and the internal conduit of the feeder connects a pneumatic outlet of the mobile cam device with the pneumatic supply inlet of the thread guide group of the feeder.

In an aspect one or more of the pneumatic supply pathways of the feeder can comprise a further internal conduit of the feeder, connecting the supply outlet of the thread guide group or the supply outlet of the respective mobile cam device, with a supply inlet of the auxiliary pneumatic device group.

In an aspect the knitting machine comprises a first plurality of pneumatic supply pathways in parallel, equal in number to the plurality of feeders of the machine, each pneumatic supply pathway being configured and predisposed to receive a flow of compressed air from a compressed air source of the machine and to supply with the compressed air flow the pneumatic actuators present internally of the thread guide group of a respective feeder.

In an aspect the knitting machine comprises a second plurality of pneumatic supply pathways in parallel, equal in number to the plurality of feeders of the machine, each pneumatic supply pathway being configured and predisposed to receive a flow of compressed air from a compressed air source of the machine and to supply with the compressed air flow the pneumatic actuators present internally of the thread guide group of a respective feeder.

In an aspect the knitting machine comprises a third plurality of pneumatic supply pathways in parallel, equal in number to the plurality of feeders of the machine, each pneumatic supply pathway being configured and predisposed to receive a flow of compressed air from a compressed air source of the machine and to supply with the compressed air flow the pneumatic actuators present internally of the thread guide group of a respective feeder.

In an aspect each feeder of the knitting machine further comprises at least a respective knitting stitch regulating cam, operatively active on the needles and selectively and individually mobile so as to vary a size of the stitches produced by the needles at the respective feeder, the stitch regulating cam comprising a respective actuator, preferably a step motor, configured so as to enable a controlled movement.

In an aspect, for each feeder the respective electronic command board of the feeder is configured and predisposed to activate and command the functioning of the stitch regulating cam.

In an aspect, each feeder of the knitting machine further comprises at least a needle selecting device, provided with a plurality of actuators individually activatable so as to act on a plurality of selectors, or underneedles, each located inferiorly of a respective needle of the plurality of needles of the knitting machine, so that the selectors position the respective needle between a plurality of operating configurations, and wherein, for each feeder, the respective electronic command board of the feeder is configured and predisposed to control the functioning of the respective needle selecting device.

In an aspect at least a feeder of the knitting machine is provided with an auxiliary electronic device group, comprising one or more position sensors of the tongues and/or a needle broken detector. In an aspect, for the at least a feeder, the respective electronic command board of the feeder is configured and predisposed to command the functioning of the respective auxiliary electronic device group.

In an aspect the knitting machine is provided with a serial control ring of the feeders, comprising a sequence of sections of electric cables connecting, in series, all the feeders of the knitting machine, in such a way that each feeder is electrically and/or electronically connected to the preceding feeder and with the successive feeder, the control ring constituting a shared serial communication channel between the feeders, by means of which electrical supply and control signals can be sent to each feeder.

In an aspect the serial control ring of the feeders is one alone internally of the knitting machine. In an aspect the knitting machine comprises a central processing unit, to which the electronic command boards of the feeders are operatively connected, the central processing unit being configured so as to manage the functioning of the knitting machine and so as to send to the electronic command boards of the feeders a set of command instructions. In an aspect the serial control ring of the feeders is connected, at least in a point, to the central processing unit, so as to receive therefrom electric supply and control signals and so as to send thereto a plurality of data relating to the devices comprised in each feeder.

In an aspect the needle-bearing organ can be, equivalently, a needle plate. In an aspect the knitting machine is a circular knitting machine for knitwear, seamless knitwear, hosiery or the like.

In a further independent aspect, the present invention relates to a method for pneumatic supply and control of the feeders of a circular knitting machine, the method comprising following steps:

predisposing a circular knitting machine for knitwear or hosiery, comprising:

a bearing structure;

at least a needle-bearing organ or needle cylinder rotatably mounted in the bearing structure;

a plurality of needles supported by the needle cylinder and mobile parallel to a rotation axis of the needle cylinder so as to produce a knitted fabric;

a plurality of thread feeding points, or feeders, where the thread is supplied to the needles of the machine, the feeders being positioned circumferentially about the needle-bearing organ and distanced angularly between them;

predisposing, for each feeder, a respective feeder control electronic board, in each feeder, commanding, via a respective electronic feeder command board, the whole pneumatic part of the feeder, i.e. the solenoid valves present in the feeder so as to selectively actuate the pneumatic actuators present in the feeder.

Each of the above aspects of the invention can be taken alone or in combination with any one of the claims or other described aspects.

Further characteristics and advantages will emerge more clearly from the detailed description of some embodiments, among which also a preferred embodiment, by way of non-exclusive example, of a circular knitting machine according to the present invention and a method for pneumatically supplying and controlling the feeders of a circular knitting machine according to the present invention. The description will be set down in the following with reference to the appended drawings, provided by way of non-limiting example, in which.

FIGS. 5, 6, 7A, 7B, 8A, 8B, 9, 10, 11, 12, 13 and 14 each schematically illustrate a possible embodiment of a knitting machine according to the present invention, in particular illustrating the feeders, the relative components and the pneumatic pathway, or pathways that supply the pneumatic actuators of the feeders.

With reference to the figures, reference number 1 denotes in its entirety a circular knitting machine according to the present invention, while numeral 3 denotes a single feeder of the knitting machine. In general, the same reference number is used for identical or like elements, possibly in the variant embodiments thereof.

Figure 1:
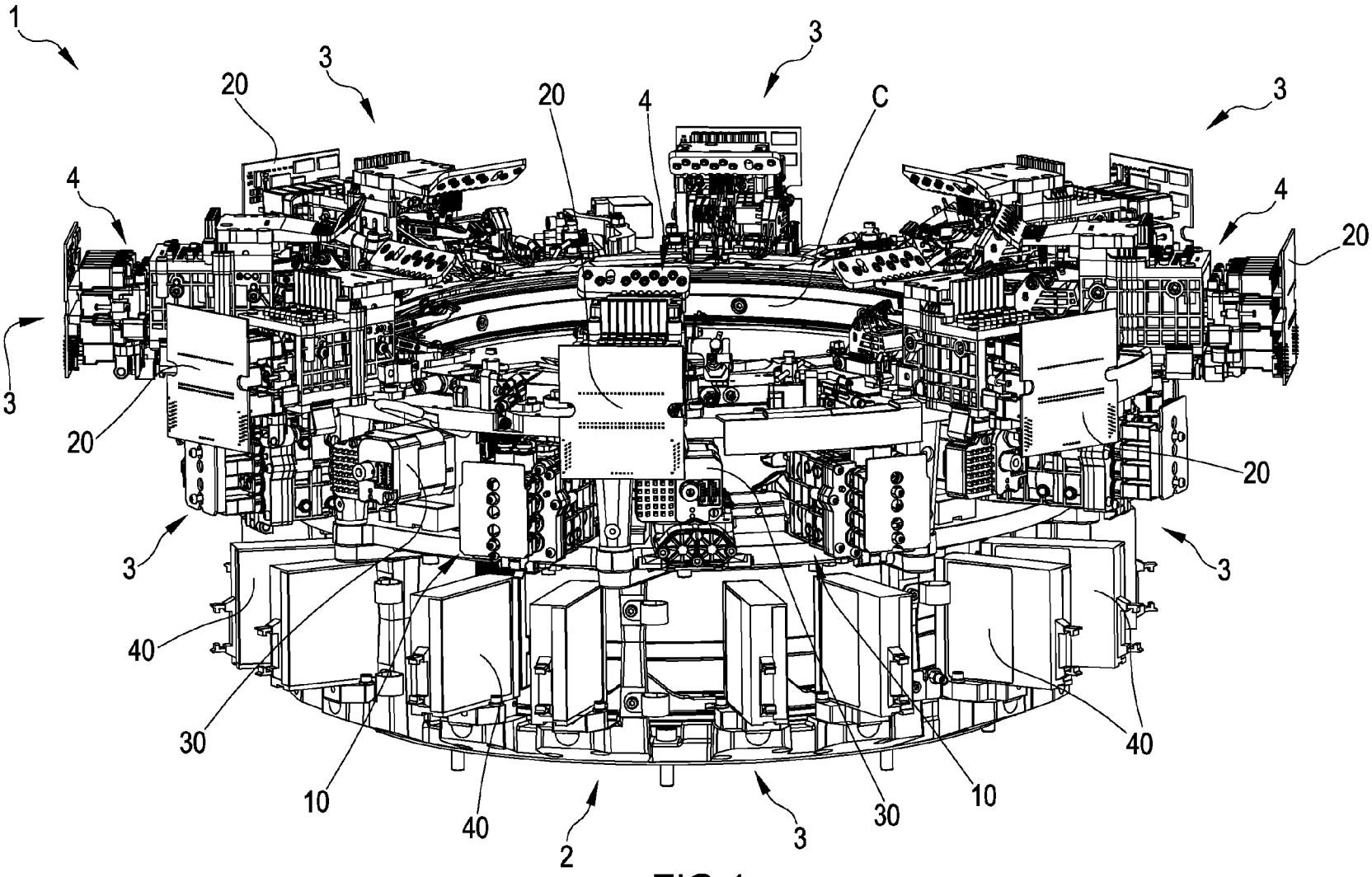
FIG. 1 is a perspective view of a possible embodiment of a circular knitting machine according to the present invention, with some parts removed and showing in particular the needle-bearing organ and the feeders.
Figure 2:
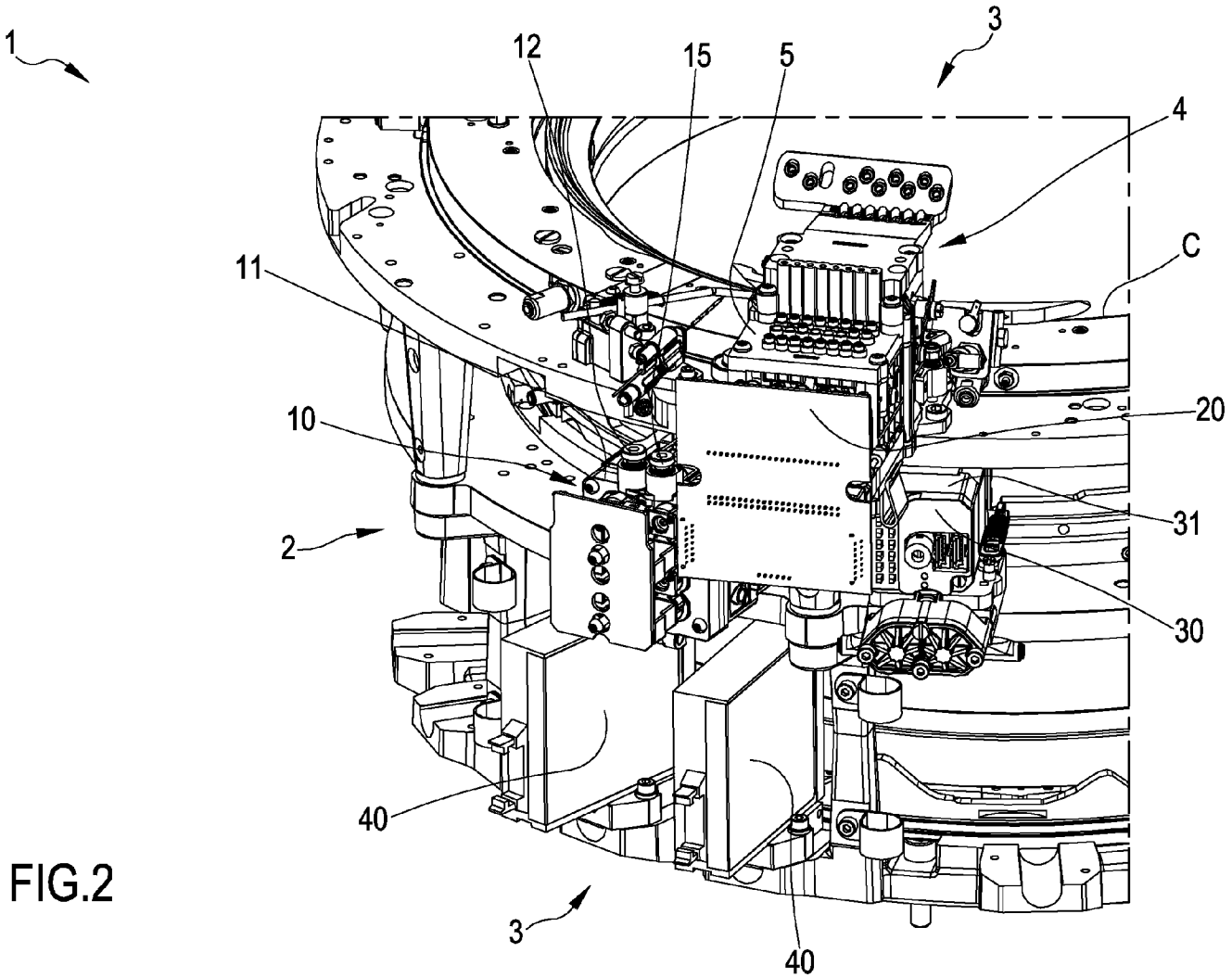
FIG. 2 is a perspective view of a portion of the circular knitting machine of FIG. 1, with some parts removed, and showing in particular a single feeder, in a possible embodiment, complete with the respective devices and components.
Figure 3:
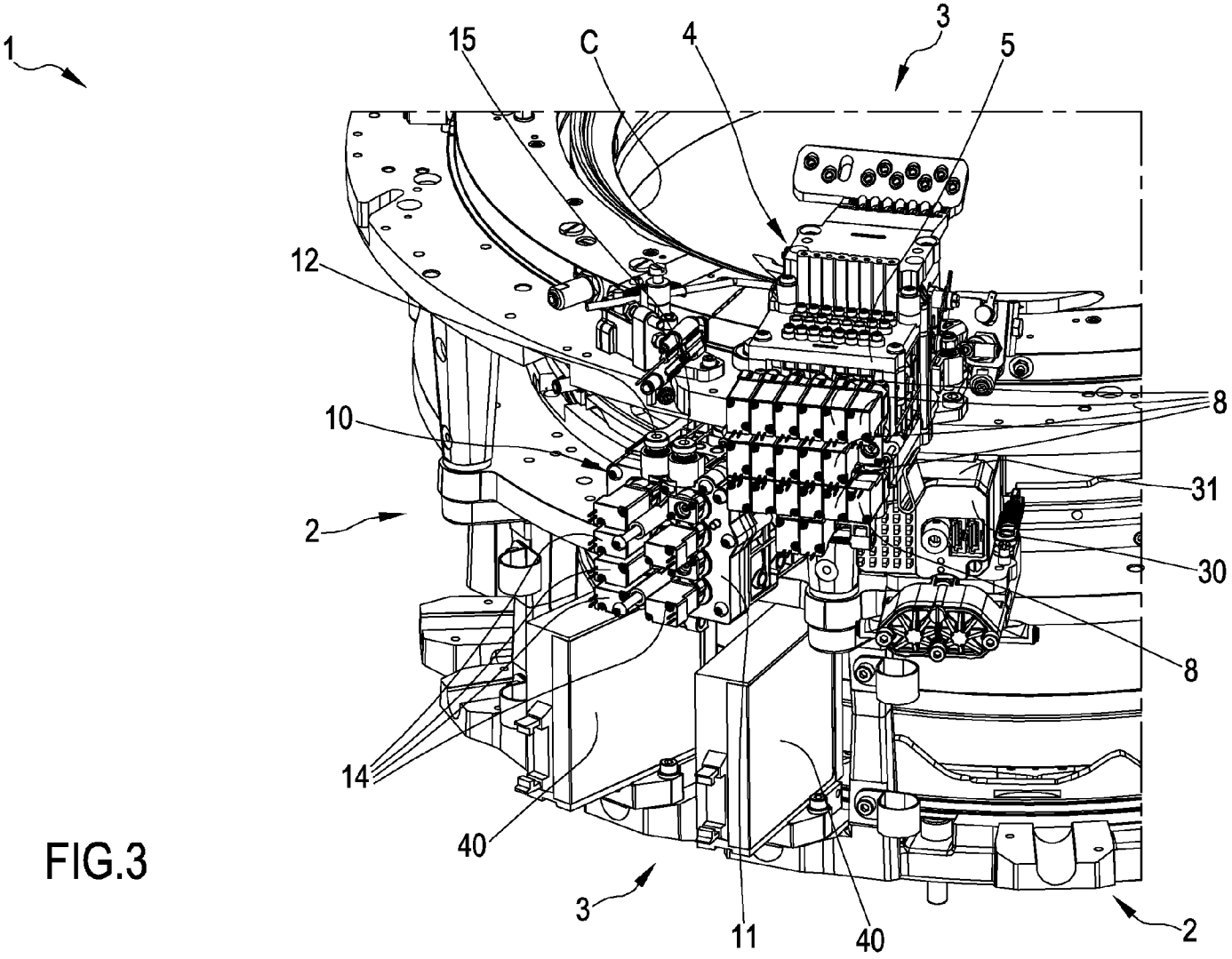
FIG. 3 is a perspective view (from above) of the single feeder of FIG. 2, with some components removed with the aim of showing specific internal components of the devices of the feeder.
Figure 4:
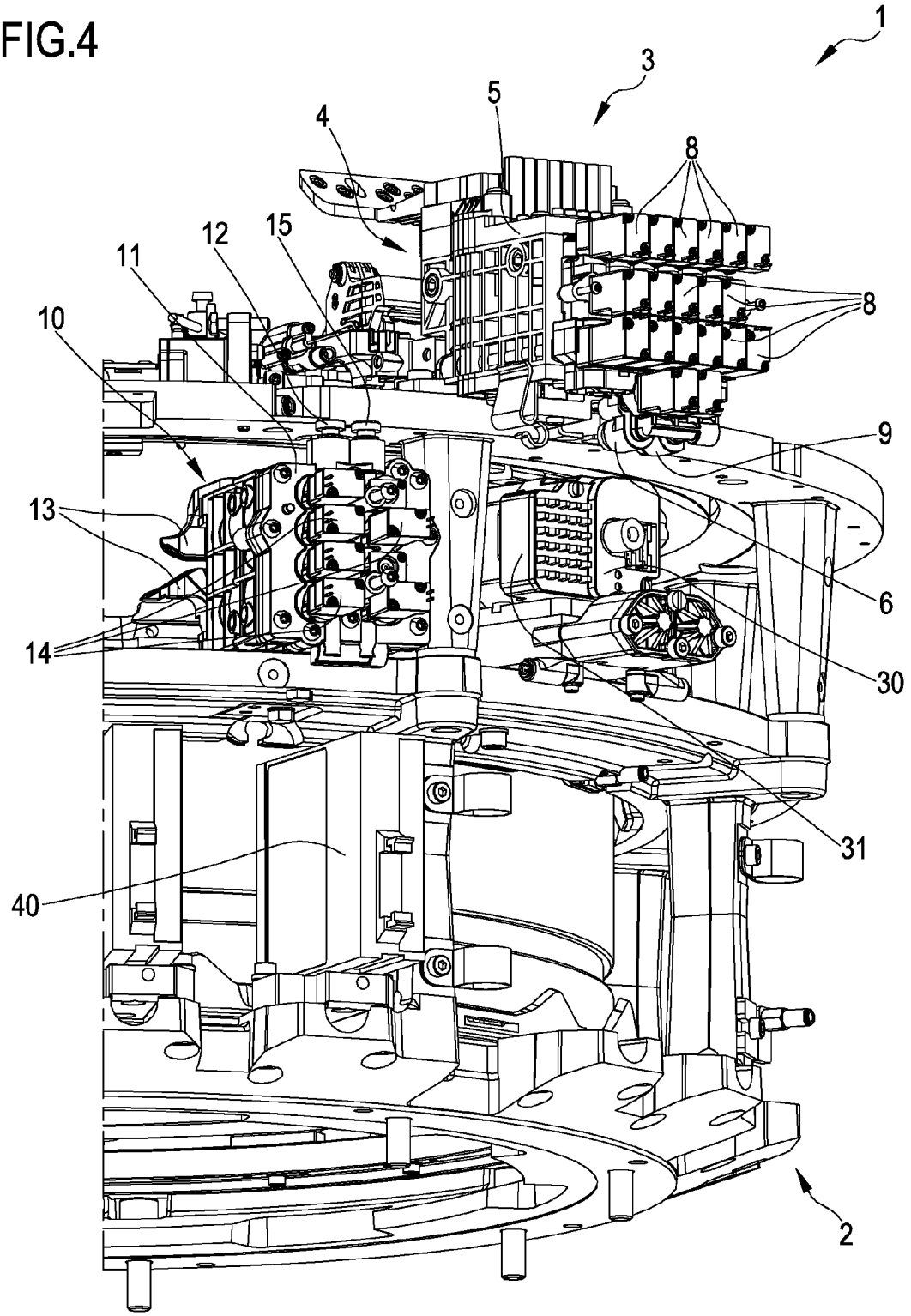
FIG. 4 is a further perspective view (from below) of the feeder of FIG. 3.
Figure 5:
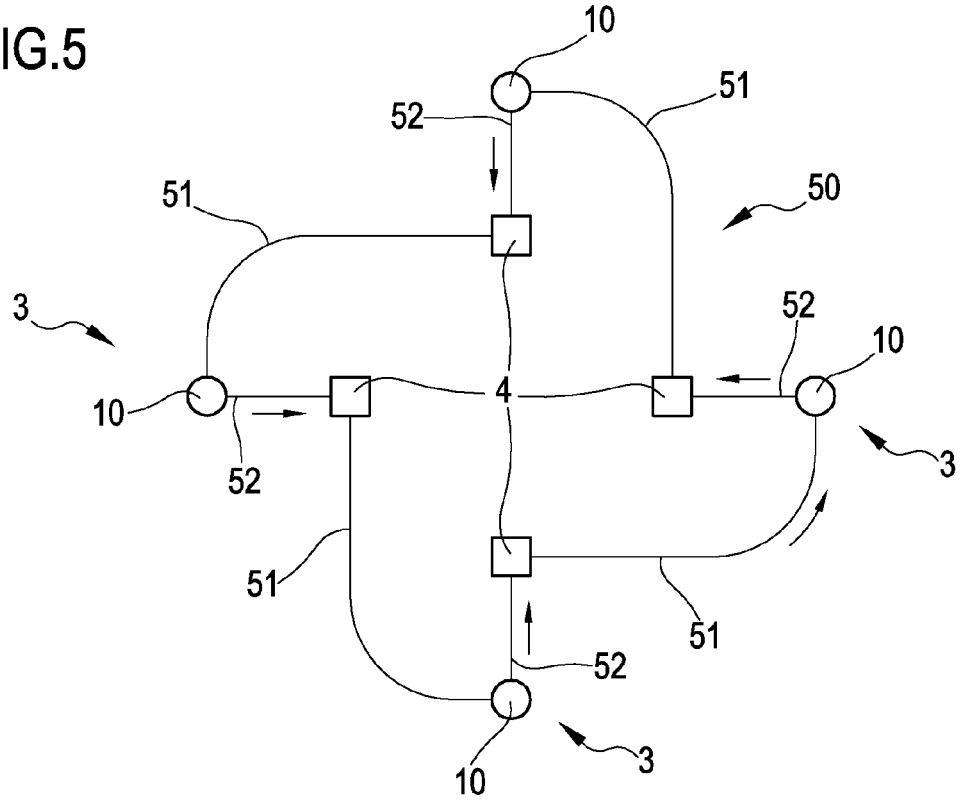

FIG. 1 illustrates a possible embodiment of a knitting machine according to the present invention, with some parts removed. In particular, the illustration of the machine is focussed on the knitting head and the elements connected thereto (cylinder, needles, feeders) and functional for the comprehension of the present invention. The base of the knitting machine, the section comprising the processing board and other parts of the knitting machine are not illustrated in detail in the figures, as they are of known type and conventional. From the point of view of textile technology, the functioning of the whole knitting machine (for example the functioning of the knitting head, the cooperation between needles and threads, etc.) is not described in detail, as it is known in the technical sector of the present invention.

The circular knitting machine for knitwear or seamless knitwear or hosiery, comprises a bearing structure 2, at least a needle-bearing organ or a needle cylinder C rotatably mounted on the bearing structure, and a plurality of needles supported by the needle cylinder C and mobile parallel to a rotation axis of the needle cylinder so as to produce a knitted fabric. The needle cylinder C can have a variable diameter according to knitting needs; for example the diameter can be 4 inches, 8 inches, 16 inches, 24 inches. The needle-bearing organ can equivalently be a needle plate.

The machine further comprises a plurality of thread feeding points 8, or feeders, in which the thread is supplied to the needles of the machine. The feeders 8 are positioned circumferentially about the needle-bearing organ and distanced angularly from one another. FIG. 1 shows a knitting machine comprising, by way of example, eight feeders, distributed angularly and uniformly about the needle cylinder. The knitting machine can comprise a variable number of feeders, for example 2, 4, 6, 8, 10, 12, 16 or more.

Each feeder 3 comprises at least a device for supplying thread to the plurality of needles, or thread guide group 4, comprising a body 5 of the thread guide group, a pneumatic supply inlet, i.e. a compressed air flow, a plurality of thread guide organs or thread guides, arranged laterally to the needle-bearing organ at the respective feeder, and a plurality of pneumatic actuators movably housed in the body of the thread guide group and configured so as to controlledly move the plurality of thread guides. The thread guide group comprises a plurality of solenoid valves 8 mounted and connected directly to the body 5 of the thread guide group, each solenoid valve being configured and predisposed to activate or deactivate the pneumatic supply to a respective pneumatic actuator of the thread guide group, with the aim of selectively actuating the respective actuator.

Each feeder 3 comprises a mobile cam device 10 for control of the needles, comprising a respective body 11 of the mobile cam device, a respective pneumatic supply inlet 12, i.e. a flow of compressed air, one or more command cams 13 movably mounted to the body 11 and able to interact with the needles, and a respective plurality of pneumatic actuators movably housed in the body 11 and configured so as to controlledly move the command cams 13. The mobile cam device comprises a respective plurality of solenoid valves 14 mounted and connected directly to the body 11 of the mobile cam device; each solenoid valve 14 being configured and predisposed to activate or deactivate the pneumatic supply of a respective pneumatic actuator of the device, with the aim of selectively actuating the respective actuator.

Each feeder 3 further comprises an electronic feeder command board 20, for example located on the thread guide group 4, configured and predisposed to command at least the solenoid valves 8 of the thread guide group 4 and the solenoid valves 14 of the mobile cam device 10, with the aim of selectively actuating the pneumatic actuators of the thread guide group 4 and the pneumatic actuators of the mobile cam device 10.

It is noted that in the present invention the solenoid valves of the feeders and the mobile cam devices (and possibly also the solenoid valves of further pneumatic actuators of the feeders) are positioned directly on the respective device, i.e. are delocalized with respect to the central unit of the knitting machine and located directly in the respective feeder.

The knitting machine 1 further comprises at least a pneumatic supply pathway 50 able to supply the pneumatic actuators of the plurality of feeders 3 of the machine.

The machine preferably comprises exactly a single serial pneumatic supply pathway 50 developing annularly about the rotation axis of the cylinder, the single pneumatic supply pathway comprising a pneumatic conduit or a sequence of sections of pneumatic conduit connecting, in series, all the feeders 3 of the knitting machine, in such a way that along the pneumatic supply pathway each feeder is pneumatically connected to the preceding feeder and to the following feeder.

FIGS. 8-13 schematically illustrate some possible configurations that the pneumatic supply pathway can assume in a knitting machine according to the present invention. Specially highlighted are the supply pathway, the feeders and the main devices of the feeders, i.e. the thread guide group and the mobile cam devices.

According to some embodiments of the present invention, the above-cited sequence of sections of the single pneumatic supply pathway 50 of the machine preferably comprises a plurality of connecting conduits 51 between distinct feeders and a plurality of internal conduits 52 in each feeder 3, arranged in alternating series. As shown schematically in FIG. 5, each connecting conduit S1 is preferably interposed and shared between two adjacent feeders 3, connecting a pneumatic supply outlet 9 of the feeders 4 of a preceding feeder with the pneumatic supply inlet 12 of the mobile cam device 10 of the successive feeder.

Figure 6:
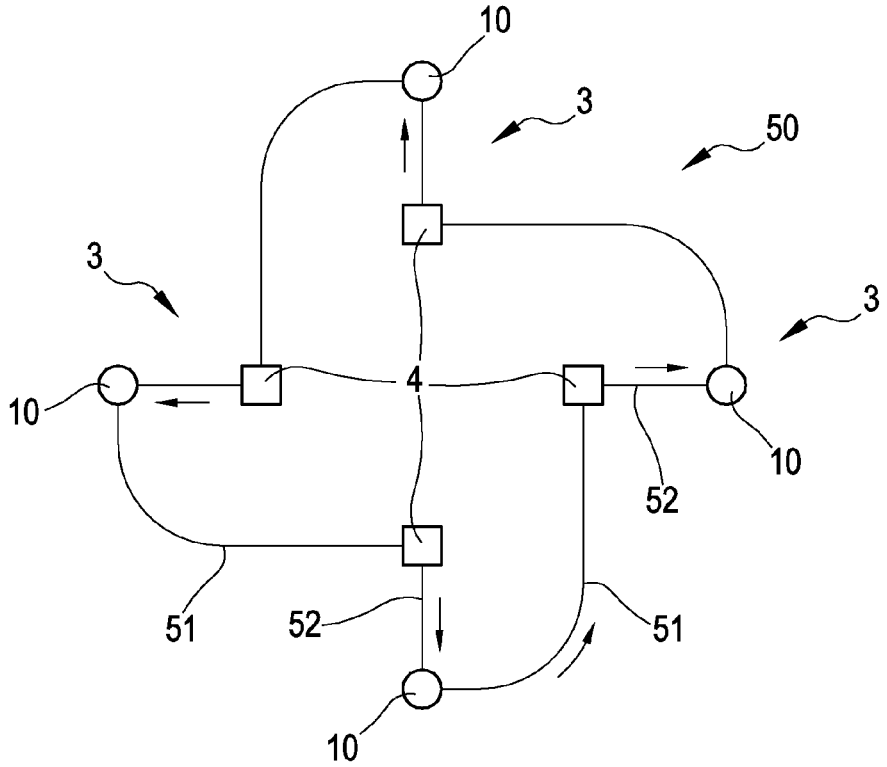

Vice versa, but with the same result, as shown schematically in FIG. 6, a variant can be provided in which each connecting conduit S1 is interposed and shared between two adjacent feeders, connecting a pneumatic supply outlet 15 of the mobile cam device 10 of a preceding feeder with the pneumatic supply inlet 6 of the thread guide group 4 of the following feeder. As shown schematically in FIG. 5, each internal conduit 52 preferably connects a pneumatic supply outlet of the mobile cam device 10 of a respective feeder 3 with the respective pneumatic supply inlet 6 of the thread guide group 4 of the same feeder 3.

Vice versa, but with the same result, as shown schematically in FIG. 6, an embodiment can be provided in which each internal conduit 52 connects a pneumatic supply outlet 9 of the thread guide group 4 of a respective feeder 3 with the respective pneumatic supply inlet 6 of the mobile cam group 10 of the same feeder 3. each internal conduit being comprised in the feeder. Each internal conduit is comprised in the respective feeder.

In other words, the sequence of sections is preferably realised as an alternation of connecting conduits 51 and internal conduits 52, which connect in sequence a thread guide group—a mobile cam device—thread guide group—and so on. A connecting conduit S1 is present between a feeder 3 and a next feeder 3, while an internal conduit 52 is present between the thread guide group and the mobile cam device of the feeder. The pneumatic supply pathway 50 is therefore realized via a serial alternation of devices (thread guide device and mobile cam devices) and conduits (connecting and internal).

Overall, the connecting conduits 51 and the internal conduits 52 connect, in sequence and alternatingly, the thread guide group and the mobile cam devices of the plurality of feeders, realizing the above-cited single pneumatic supply pathway 50 of the machine. The pneumatic supply pathway assumes a circular or ring conformation.

Figure 7A:
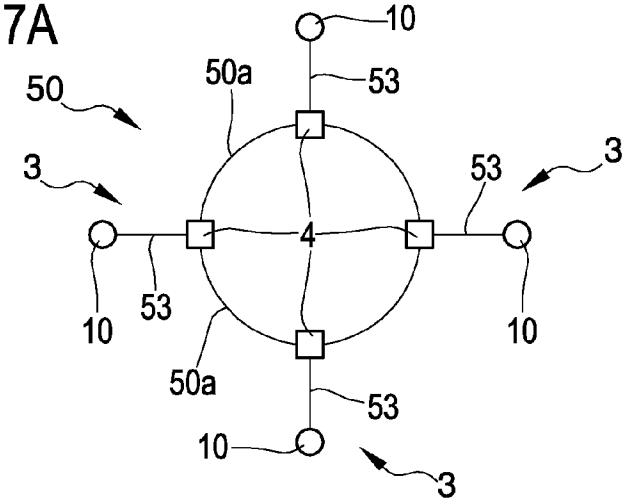
Figure 7B:
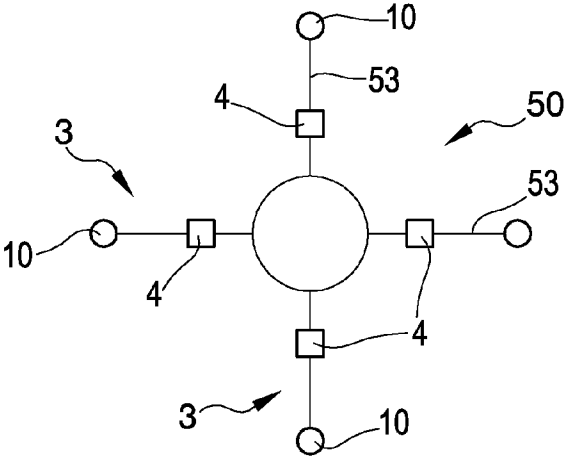

In a further embodiment, the pneumatic conduit or the sequence of sections of pneumatic conduit (of the single pneumatic supply pathway 50) connect, in series among them, all the thread guide groups 4 of the feeders 3, and the sequence of sections of the single pneumatic supply pathway of the machine further comprises a plurality of internal branch conduits 53 of each feeder 3 and each connecting a secondary pneumatic supply outlet 54 of the thread guide group 4 of a respective feeder with the respective pneumatic supply inlet 12 of the mobile cam device 10 of the feeder 3. FIGS. 7A and 7B schematically illustrate this embodiment. In particular, FIG. 7A shows the supply pathway 50 realised as a sequence of sections of pneumatic conduit 50*a* connecting in series all the thread guide groups 4 of the feeders 3, to which are added internal branching conduits 53 to each feeder 3, each connecting the thread guide group of the feeder with the respective mobile cam device. In FIG. 7B, alternative to the preceding case, the supply pathway 50 is realized as a single circular pneumatic conduit to which are connected all the thread guide groups 4 of the feeders 3, and additionally internal branching groups are present in each feeder 3, each connecting the thread guide group of the feeder with the respective mobile cam device.

According to a further embodiment, alternatively to those of FIGS. 7A and 7B, the pneumatic conduit or the sequence of sections of pneumatic conduit (of the single pneumatic supply pathway 50) connect, in series among them, all the mobile cam devices 10 of the feeders 3 and wherein the sequence of sections of the single pneumatic supply pathway of the machine further comprises a plurality of branch conduits 53 internal of each feeder which conduits 53 each connect a secondary pneumatic supply outlet 54 of the mobile cam device 10 of a respective feeder with the respective pneumatic supply inlet 6 of the thread guide group 4 of the same feeder 3.

Figure 8A:
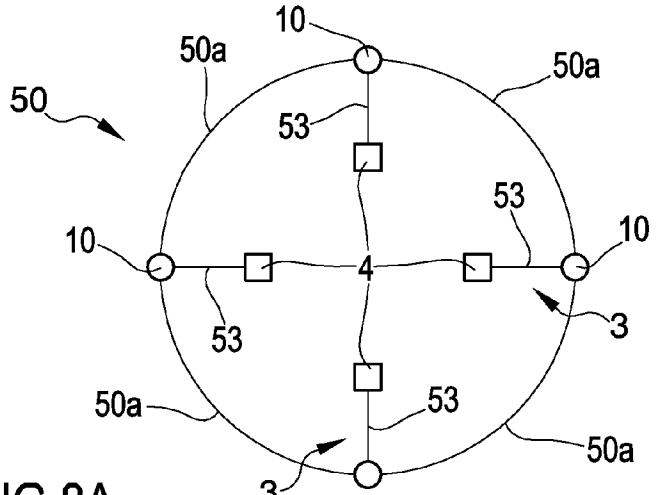
Figure 8B:
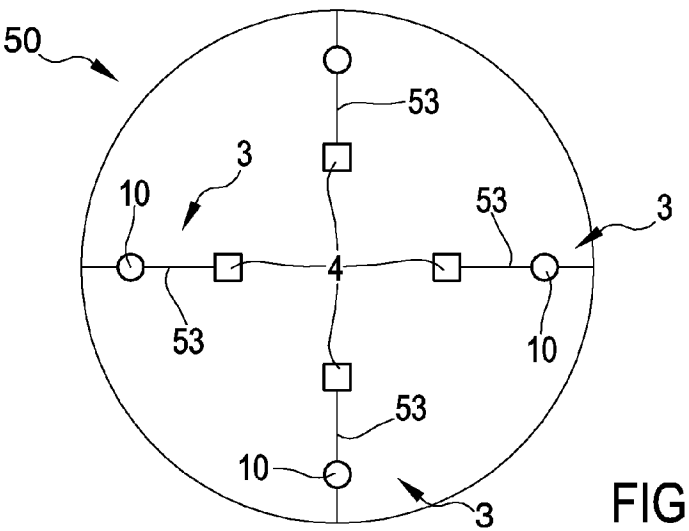

FIGS. 8A and 8B schematically illustrate this embodiment. In particular, FIG. 8A illustrates the supply pathway 50 realised as a sequence of sections of pneumatic conduit 50*a* connecting in series all the mobile cam devices 10 of the feeders 3, to which are added internal branching conduits 53 of each feeder, each connecting the mobile cam devices of the feeder with the respective thread guide group. In FIG. 8B, alternatively to the preceding case, the supply pathway 50 is realized as a single circular pneumatic conduit to which are connected all the mobile cam devices 10 of the feeders 3, and additionally there are also internal branching conduits 53 in each feeder 3, each connecting the mobile cam device of the feeder with the respective thread guide group.

The embodiments of FIGS. 7A, 7B, 8A and 8B are functionally equivalent.

The electronic command board 20 of each feeder 3 is preferably configured and predisposed to command all of the solenoid valves present internally of the feeder 3, with the aim of selectively actuating all the pneumatic actuators of the feeder 3. In other words, the control of the whole pneumatic part of the feeder (i.e. all the pneumatic actuators present in the feeder) is delegated to the electronic board of the feeder.

Each feeder 3 of the knitting machine preferably comprises a single electronic command board 20.

The knitting machine preferably comprises a single electronic command board 20 for each feeder 3. Alternatively, the knitting machine comprises a plurality of the electronic boards 20, each of which is configured and predisposed to command at least the solenoid valves of the thread guide group and the solenoid valves of the mobile cam device of at least two feeders; in other words, an electronic board can be shared by a plurality of feeders.

The electronic command board 20 of each feeder 3 is preferably positioned on the respective thread guide group 4 of the feeder; alternatively, the board 20 can be positioned on the respective mobile cam device 10 of the feeder. The electronic command board 20 preferably coincides with the electronic board of the thread guide group, which is connected to the mobile cam device (and possible also to other organs of the feeder) to manage the functions thereof. In a further embodiment, as schematically illustrated in FIG. 10, the knitting machine comprises a first serial pneumatic supply pathway 61, developing annularly about the rotation axis of the cylinder, comprising a pneumatic conduit or a sequence of sections 61*a* of pneumatic conduit connecting, in series, the thread guide groups 4 of all the feeders 3 of the knitting machine, in such a way that along the first pneumatic supply pathway each thread guide group 4 is pneumatically connected with the preceding thread guide group and with the successive thread guide group.

Figure 10:
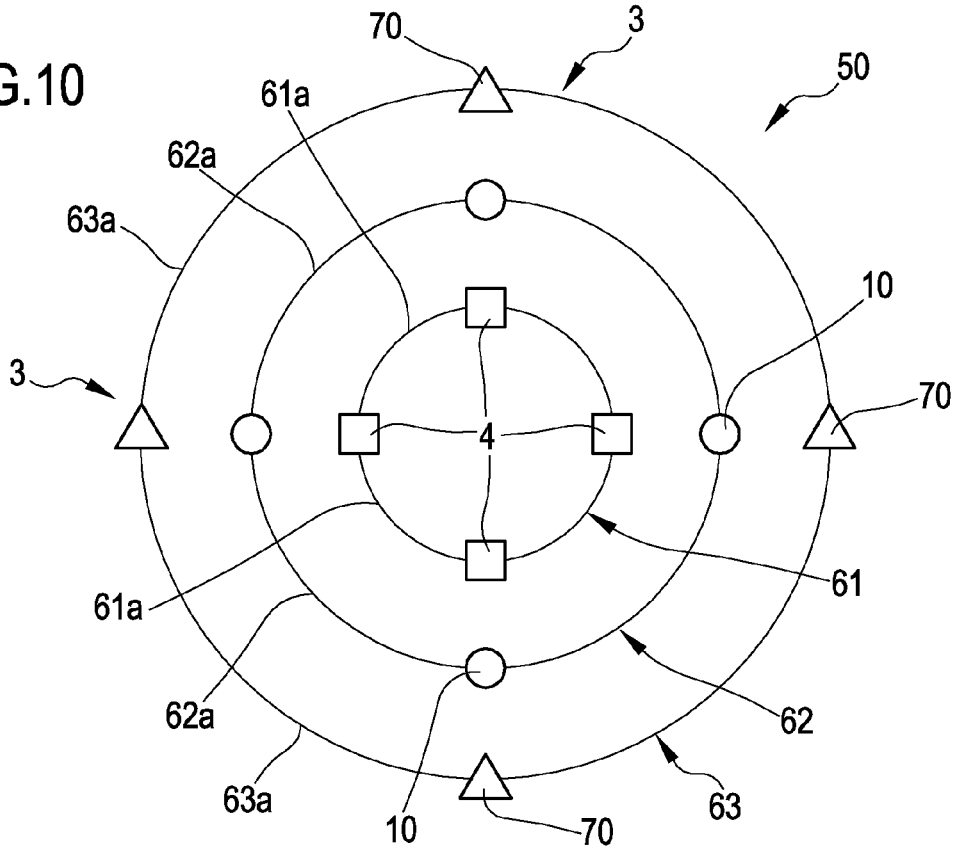

As schematically represented in FIG. 10, the knitting machine further comprises a second serial pneumatic supply pathway 62, developing annularly about the rotation axis of the cylinder, comprising a respective pneumatic conduit or a respective sequence of sections 62*a* of pneumatic conduit connecting, in series, the mobile cam devices 10 of all the feeders 3 of the knitting machine, in such a way that along the second pneumatic supply pathway each mobile cam device 10 is connected pneumatically with the preceding mobile cam device and with the successive mobile cam device.

In a possible embodiment, at least a feeder of the knitting machine is provided with a group of auxiliary pneumatic devices 70, comprising a pneumatic actuator for moving a position sensor of the tongues and/or a pneumatic actuator for moving a needle-broken detector and/or a pneumatic for commanding the opening of the needles and/or a pneumatic actuator for commanding the sponge plate cam; the auxiliary pneumatic devices group comprises a respective pneumatic supply inlet, i.e. a compressed air flow, one or more pneumatic actuators configured to controlledly move one or more of the auxiliary pneumatic devices and one or more solenoid valves mounted directly or connected to the auxiliary devices, each solenoid valve being configured and predisposed to activate or deactivate the pneumatic supply to a respective pneumatic actuator of the auxiliary pneumatic devices group, with the aim of selectively activating the respective actuator.

Figure 9:
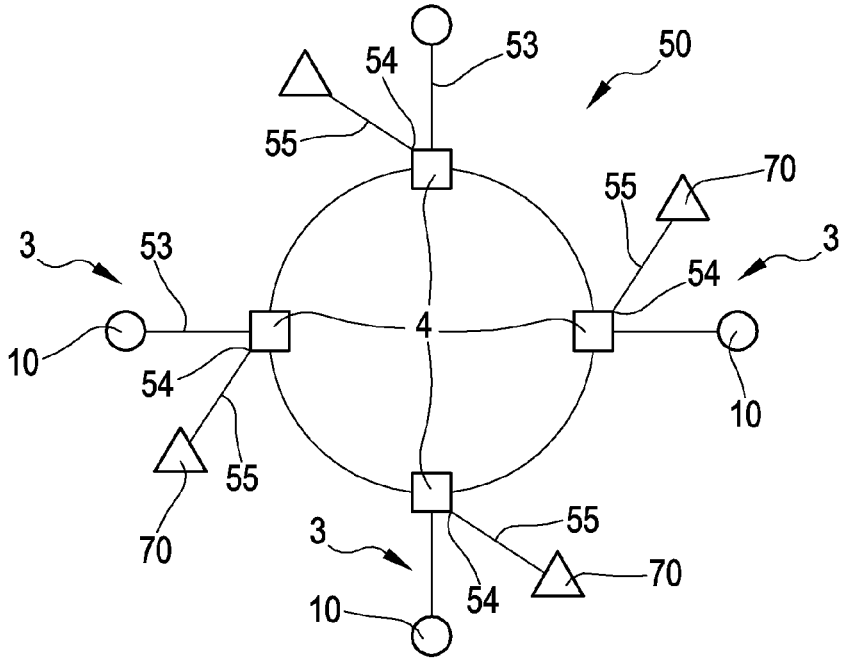

As shown schematically in FIG. 9, the single pneumatic supply pathway 50 preferably comprises a plurality of internal conduits 55 connecting for each feeder the supply outlet of the supply to the respective thread guide group, or equivalently the supply outlet of the respective mobile cam device, with a supply inlet of the auxiliary pneumatic device group. The auxiliary pneumatic devices can be present in all the feeders or only in some of the feeders of the knitting machine.

As schematically shown in FIG. 10, the knitting machine can comprise a third serial pneumatic supply pathway 63, developing annularly about the rotation axis of the cylinder and comprising a respective pneumatic conduit or a respective sequence of pneumatic conduit sections 63*a* connecting, in series, the groups of auxiliary pneumatic devices 70 of all the feeders of the knitting machine, so that along the third pneumatic supply pathway each group of auxiliary pneumatic devices is connected pneumatically with the preceding auxiliary pneumatic devices group and the following auxiliary pneumatic devices group.

FIG. 10 schematically illustrates the first pathway 61, the second pathway 62 and the third pathway 63 of pneumatic supply of the knitting machine, respectively supplying in series the thread guide group, the mobile cam group and the auxiliary pneumatic devices.

The electronic command board 20 of the feeder 3 is configured so as to selectively activate also the pneumatic actuators of the respective auxiliary device group, by commanding the respective solenoid valves.

Figure 11:
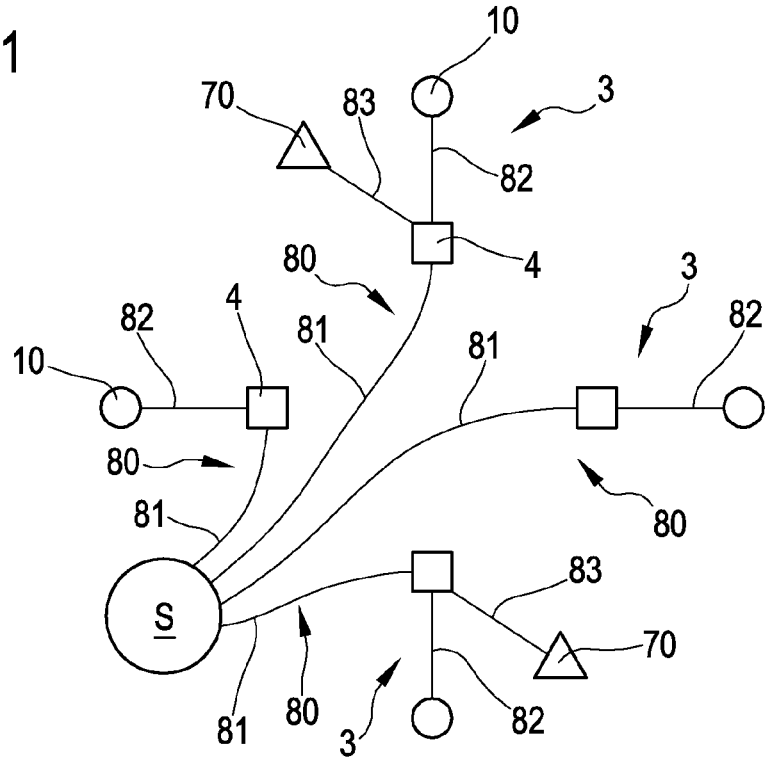

In a further embodiment, alternative to the preceding ones and shown schematically in FIG. 11, the knitting machine comprises a plurality of pneumatic supply pathways 80 for the feeders, in a reciprocally parallel arrangement, equal in number to the plurality of feeders 3 of the machine, each pneumatic supply pathway 80 to the feeder 3 being configured and predisposed to receive a compressed air flow from a source S of compressed air of the machine and to supply, with the compressed air flow, the pneumatic actuators present internally of a respective feeder. Each pneumatic supply path 80 to the feeders preferably comprises a connecting conduit 81 connecting the compressed air source with the pneumatic supply inlet 6 of the thread guide group 4 of the respective feeder supplied by the supply pathway, and at least an internal conduit 82 to the feeder, connecting a pneumatic outlet 9 of the thread guide group with the pneumatic supply inlet 12 of the mobile cam device of the feeder 3.

Figure 12:
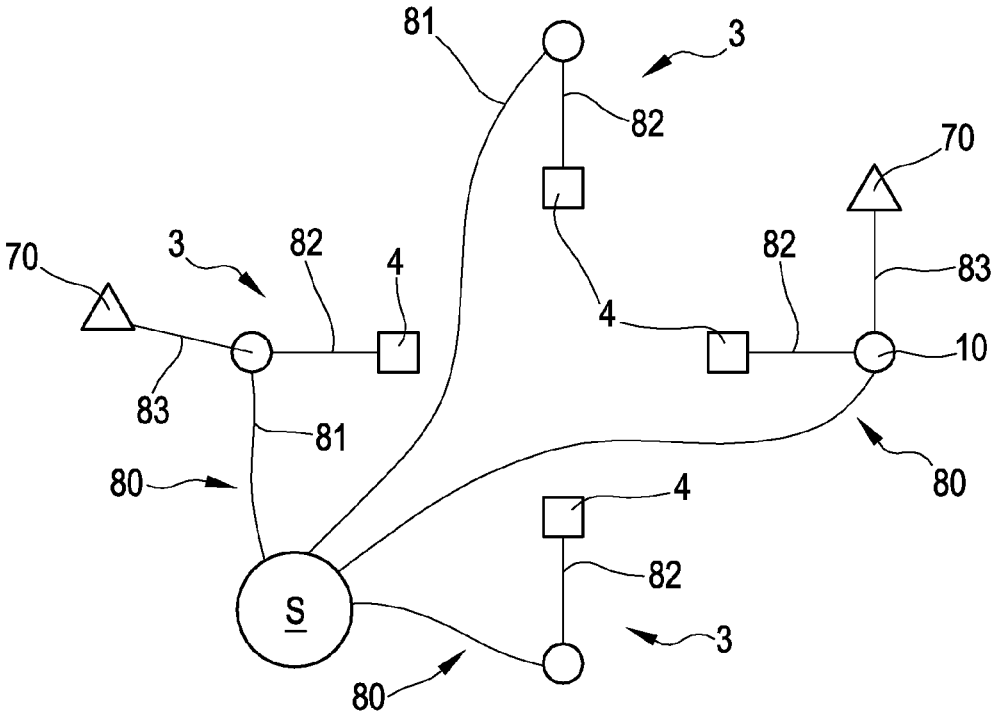

Alternatively, as shown schematically in FIG. 12, the respective connecting conduit 81 of each pathway 80 of pneumatic supply to the feeders connects the source of compressed air with the pneumatic supply inlet 12 of the mobile cam device 10 of the respective feeder 3 supplied by the supply pathway, and the internal conduit 82 of the feeder connects a pneumatic outlet 15 of the mobile cam device 10 with the pneumatic supply inlet of the thread guide group 4 of the feeder 3. As shown schematically in FIG. 11, one or more of the pneumatic supply pathways 80 of the feeder comprises a further internal conduit 83 of the feeder, connecting the supply outlet 9 of the thread guide group 4 or the supply outlet 15 of the respective mobile cam device 10, with a supply inlet of the auxiliary pneumatic device group 70.

Figure 13:
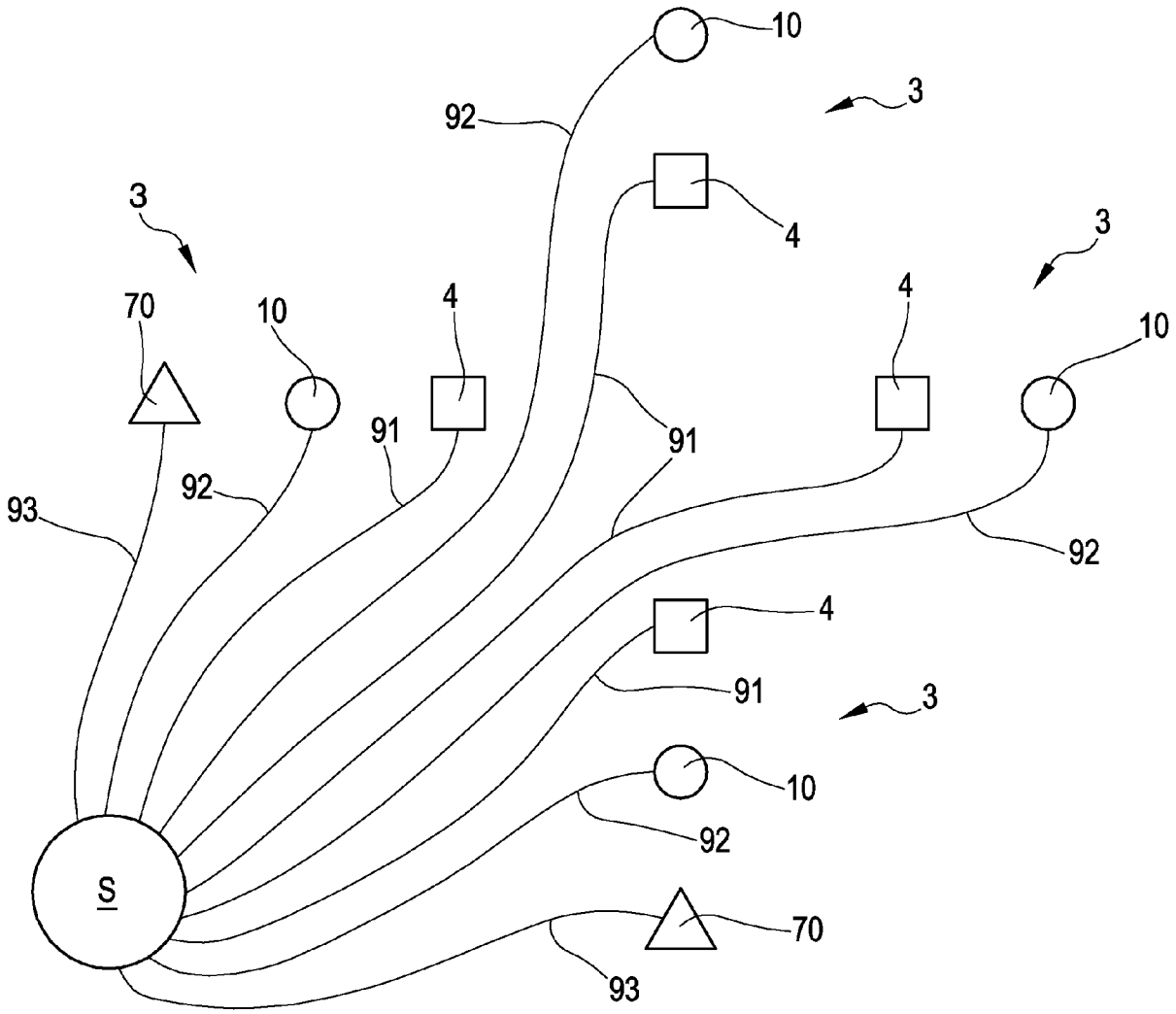

In a further embodiment, shown schematically by way of example in FIG. 13, the knitting machine comprises a first plurality of pneumatic supply pathways 91 in parallel, equal in number to the plurality of feeders 3 of the machine, each pneumatic supply pathway being configured and predisposed to receive a flow of compressed air from a compressed air source of the machine and to supply with the compressed air flow the pneumatic actuators present internally of the thread guide group 4 of a respective feeder.

As shown schematically by way of example in FIG. 13, the knitting machine can preferably comprise a second plurality of pneumatic supply pathways 92 in parallel, equal in number to the plurality of feeders 3 of the machine, each pneumatic supply pathway being configured and predisposed to receive a flow of compressed air from a source of compressed air of the machine and to supply with the compressed air flow the pneumatic actuators present internally of the mobile cam group 10 of a respective feeder.

As shown schematically by way of example in FIG. 13, the knitting machine comprises a third plurality 93 of pneumatic supply pathways in parallel, equal in number to the plurality of feeders 3 of the machine, which are provided with a group of auxiliary pneumatic devices, each pneumatic supply pathway being configured and predisposed to receive a flow of compressed air from a compressed source air of the machine and to supply with the compressed air flow the pneumatic actuators present internally of the auxiliary pneumatic devices group 70 of a respective feeder. FIG. 13 schematically illustrates the first plurality of pathways 91, the second plurality of pathways 92 and the third plurality of pathways 93 for parallel pneumatic supply to the knitting machine, respectively and in parallel supplying the thread guide groups, the mobile cam devices and the auxiliary pneumatic devices. In some possible embodiments, which are within the scope of the present invention, the plurality of pathways in parallel 91, 92 and 93, can be partially present in the knitting machine and possibly flanked by pathways in series. For example, a single pathway 50 can supply the thread guide groups of the feeders in series, and can supply, via a plurality of pathways, the mobile cam devices in parallel.

The knitting machine 1 preferably comprises a compressed air source S (internal or external of the machine, not shown in FIGS. 1-4 as of known type) to which the pneumatic supply pathway is connected (or the plurality of pneumatic supply pathways), so as to receive therefrom a flow of compressed air; in practice the compressed air source supplied the pneumatic supply pathway. In the embodiments schematically represented in FIGS. 5-10, the compressed air source is not illustrated as it can be connected to the supply pathway at any point thereof, via which the flow of compressed air coming from the source is injected into the supply pathway in order to reach the feeders of the machine. For example, the compressed air source can coincide with a start of the pneumatic supply pathway, or the pneumatic supply pathway can terminate at the last feeder of the knitting machine, or can be ring-closed on itself, in which case the end of the supply pathway coincides with the start.

Figure 14:
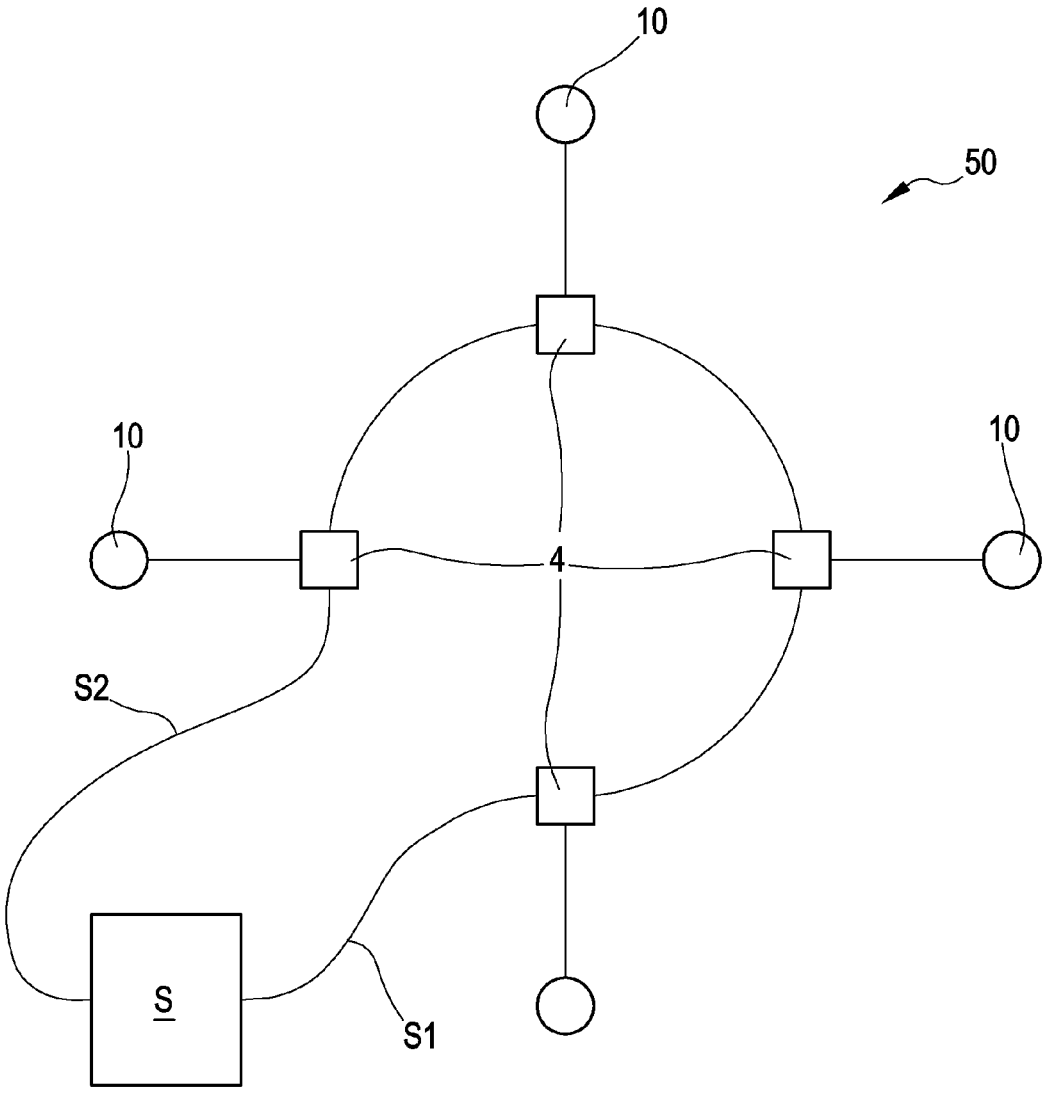

FIG. 14 schematically illustrates an embodiment in which the compressed air source S is placed in series with the pneumatic supply pathway 50. In this case, the source S is an integral part of the pneumatic supply pathway: in this case the plurality of sections of pneumatic conduit making up the pathway comprises the connecting sections between adjacent feeder and, in addition, comprises:

an outward conduit S1 which connects the source S with a first feeder (in the running direction of the supply pathway);

a return conduit S2 which connects the final feeder (in the running direction of the supply pathway) with the source S.

The two conduits 51 and S2 complete the pneumatic supply pathway 50.

Note that the presence of two connecting conduits directly connected to the source S (internally of a ring-closed supply pathway) enable arranging two distinct conduits usable for injecting compressed air into the supply pathway. In other words, the two conduits 51 and S2 advantageously enable obtaining a "redundancy" of the source-feeder connection: in fact, even on closing or removing one of the two conduits 51 or S2, the source is in any case able to supply the whole pathway and reach all the feeders. Additionally, it makes it possible to remove a connecting conduit between two adjacent feeders, without this compromising the functioning of the machine: in fact, by "disconnecting" two adjacent feeders from one another, but maintaining at the same time the two conduits 51 and S2, the supply pathway 50 assumes the form of two "blind" semi-pathways, branching from the source S by means of the two conduits 51 and S2 and able to reach, from two opposite directions, all the feeders, up to the two non-connected ones. The source S can comprise a filtration group and/or a regulating group and/or a compressed air lubricating group injected into the pneumatic supply pathway of the knitting machine.

As shown by way of example in FIGS. 1-4, each feeder 3 of the knitting machine 1 preferably further comprises at least a respective knitting stitch regulating cam (30), operatively active on the needles and selectively and individually mobile so as to vary a size of the stitches produced by the needles at the respective feeder. The stitch regulating cam 30 comprises a respective actuator, preferably a step motor, configured so as to enable a controlled movement of the cam. For each feeder 3, the respective electronic command board 20 of the feeder is preferably configured and predisposed to activate and command the functioning of the stitch regulating cam 30, in particular the respective actuator.

As shown by way of example in the figures, each feeder 3 of the knitting machine 1 preferably further comprises at least a needle selecting device 40, provided with a plurality of actuators individually activatable so as to act on a plurality of selectors, or underneedles, each located inferiorly of a respective needle of the plurality of needles of the knitting machine, so that the selectors position the respective needle between a plurality of operating configurations (known in the sector as technical positions, for example "needle out of work position", "needle hold position" or "needle free pass position"). For each feeder 3 the respective electronic command board 20 of the feeder is preferably configured is configured to control the functioning of the respective needle selecting device. As shown by way of example in the figures, a feeder 3 can preferably comprise two (or more) needle selecting devices.

At least a feeder of the knitting machine is preferably provided with a group of auxiliary electronic devices, comprising one or more position sensors of the tongues and/or a detector of broken needles.

The position sensor of the tongues detects an eventual non-opening of the tongue of a need during rotation of the needle cylinder, in which case it sends to the central unit a halt signal of the knitting machine. The needle-broken detector detects any fault or breakage or malfunctioning of a needle during the rotation of the needle cylinder, in which case it sends to the central unit a halt signal of the knitting machine.

For the at least a feeder, the respective electronic command board is preferably configured and predisposed to control the functioning of the respective group of auxiliary electronic devices. The electronic command board 20 of the feeder preferably comprises a series of electric/electronic inputs configured to receive, from the devices and/or sensors of the machine, data on the state of the feeder, and on the basis of that data to command the functioning of the feeder.

In a further embodiment, the knitting machine is provided with a serial control ring of the feeders, comprising a sequence of sections of electric cables connecting, in series, all the feeders of the knitting machine, in such a way that each feeder is electrically and/or electronically connected to the preceding feeder and with the successive feeder. The control ring constitutes a shared serial communication channel between the feeders 3, by means of which electric supply and control signals can be sent to each feeder.

The serial control ring of the feeders is preferably one only internal of the knitting machine. The knitting machine preferably comprises a central processing unit, to which the electronic command boards of the feeders are operatively connected, the central processing unit being configured so as to manage the functioning of the knitting machine and so as to send to the electronic command boards 20 of the feeders 3 a set of command instructions.

The serial control ring of the feeders is preferably connected, at least in a point, to the central processing unit, so as to receive therefrom electric supply and control signals and so as to send thereto a plurality of data relating to the devices comprised in each feeder.

The present invention further relates to a method for pneumatic supply and control of the feeders of a circular knitting machine. The method comprises following steps:

predisposing a circular knitting machine for knitwear or hosiery, comprising:

a bearing structure;

at least a needle-bearing organ or needle cylinder rotatably mounted in the bearing structure;

a plurality of needles supported by the needle cylinder and mobile parallel to a rotation axis of the needle cylinder so as to produce a knitted fabric;

a plurality of thread feeding points, or feeders, in which the thread is supplied to the needles of the machine, the feeders being positioned circumferentially about the needle-bearing organ and spaced angularly with respect to one another;

predisposing, for each feeder, at least:

a device for feeding thread to the plurality of needles, or "thread guide group", comprising a body of the thread guide group, an inlet 6 for pneumatic supply, i.e. a flow of compressed air, a plurality of thread feeding organs, or "feeders", arranged laterally to the needle-bearing organ at the respective feeder, and a plurality of pneumatic actuators movably housed in the body of the thread guide group and configured so as to controlledly move the plurality of feeders, the thread guide group comprising a plurality of solenoid valves mounted and connected directly to the body of the thread guide group, each solenoid valve being configured and predisposed to activate or deactivate the pneumatic supply to a respective pneumatic actuator of the thread guide group, with the aim of selectively actuating the respective actuator;

a mobile cam device for control of the needles, comprising a respective body of the mobile cam device, a respective pneumatic supply inlet, i.e. a flow of compressed air, one or more command cams movably mounted to the body and able to interact with the needles, and a respective plurality of pneumatic actuators movably housed in the body and configured to controlledly move the one or more command cams, the mobile cam device comprising a respective plurality of solenoid valves mounted and connected directly to the body of the mobile cam device, each solenoid valve being configured and predisposed to activate or deactivate the pneumatic supply of a respective pneumatic actuator of the device, with the aim of selectively actuating the respective actuator;

predisposing, for each feeder, a respective feeder command board, for example located on the thread guide group, in each feeder, commanding, via the respective electronic feeder command board, at least the solenoid valves of the thread guide group and the solenoid valves of the mobile cam device, with the aim of selectively actuating the pneumatic actuators of the thread guide group and the pneumatic actuators of the mobile cam device.

In the step of "commanding", the electronic command board of each feeder commands all the solenoid valves present internally of the feeder, with the aim of selectively activating all the pneumatic actuators present in the feeder.

The method preferably comprises a step of predisposing in the knitting machine at least a pneumatic supply pathway able to supply the pneumatic actuators of the plurality of feeders of the machine.

The step of predisposing at least a pneumatic supply pathway preferably comprises a step of realising exactly a single serial pneumatic supply pathway developing annularly about the rotation axis of the cylinder, by means of a pneumatic conduit or a sequence of sections of pneumatic conduit connecting, in series, all the feeders of the knitting machine, in such a way that along the pneumatic supply pathway each feeder is pneumatically connected to the preceding feeder and with the following feeder.

The step of realising exactly a serial pneumatic supply pathway preferably comprises a step of realizing the above-described sequence of sections of conduit of the single pneumatic supply pathway of the machine by means of a plurality of connecting conduits between distinct feeders and a plurality of conduits internal of each feeder, arranged in alternated series.

The step of realising exactly a serial pneumatic supply pathway preferably comprises steps of interposing each connecting conduit between two adjacent feeders, connecting a pneumatic supply outlet of the mobile cam device of a preceding feeder with the pneumatic supply inlet of the thread guide group of the following feeder, or vice versa, and connecting, with each internal conduit, a pneumatic supply outlet of the thread guide group of a respective feeder with the respective pneumatic supply inlet of the mobile cam device of the same feeder, each internal conduit being comprised in the respective feeder, or vice versa.

The method preferably comprises steps of: connecting all the thread guide groups of the feeder in series with one another, via the pneumatic conduit or the sequence of sections of pneumatic conduit; predisposing, in the sequence of sections of the single pneumatic pathway of the machine, a plurality of branching conduits internal of each feeder; connecting, by means of each internal branching conduit, a second pneumatic outlet of the feeder group of a respective feeder with the respective pneumatic supply inlet of the mobile cam device of the same feeder.

Alternatively the method comprise steps of: connecting all the mobile cam devices of the feeders in series with one another, by means of the pneumatic conduit of the sequence of sections of pneumatic conduit; predisposing, in the section of sections of the single pneumatic supply pathway of the machine, a plurality of internal branching conduits in each feeder; connecting, by means of each internal branching conduit, a secondary pneumatic supply outlet of the mobile cam device of a respective feeder with the respective pneumatic supply inlet of the feeder group of the same feeder.

The method preferably comprises a step of predisposing, for each feeder, at least a respective knitting stitch regulating cam operatively active on the needles and selectively and individually mobile so as to vary a size of the stitches produced by the needles at the respective feeder, the stitch regulating cam comprising a respective actuator, preferably a step motor, configured so as to enable a controlled movement. In an aspect, during the step of "commanding", the respective electronic command board of the feeder activates and commands the functioning of the stitch regulating cam.

The method preferably comprises a step of predisposing, for each feeder, at least a needle selecting device, provided with a plurality of actuators individually activatable so as to act on a plurality of selectors, or underneedles, each located inferiorly of a respective needle of the plurality of needles of the knitting machine, so that the selectors position the respective needle between a plurality of operating configurations. In an aspect, during the step of "commanding", the respective electronic command board of the feeder is configured and predisposed to control the functioning of the respective needle selecting device.

The method preferably comprises a step of realising a serial control ring of the feeders of the knitting machine, predisposing a sequence of sections of electric cables connecting, in series, all the feeders of the knitting machine, in such a way that each feeder is electrically and/or electronically connected to the preceding feeder and with the successive feeder, the control ring constituting a shared serial communication channel between the feeders, by means of which electric supply and control signals can be sent to each feeder.

The method preferably comprises steps of: predisposing a central processing unit in the knitting machine; operatively connecting to the unit the electronic command boards of the feeders; by means of the central processing unit, managing the functioning of the knitting machine and sending to the electronic command boards of the feeders a set of command instructions.

The method preferably comprises a step of connecting, in at least a point thereof, the serial control ring to the central processing unit, so that the serial control ring receives therefrom control signals and sends thereto a plurality of data relating to the devices comprised in each feeder. In a preferred embodiment, the present invention discloses the use of an electronic command board for each single feeder: the electronic command board manages the devices that are part of the feeder, in particular at least the thread guide group and the mobile cam device, and specifically manages all the pneumatic part of the feeder.

The electronic board, preferably located on the thread guide group, is an "intelligent" board, i.e. it processes the commands for the solenoid valves present in the feeder and manages the receiving of signals and data coming from the various devices of the feeder (thus replacing the processing done by the central unit). Each board is therefore connected, preferably via the serial control ring, to the central unit of the knitting machine.

In substance, the present invention enables delocalizing the control of the feeders from the central unit to the single feeders, each of which is for this purpose provided with its own electronic command board. Note that, in the prior art, the control of the devices of the knitting machine is done according to a "parallel" design, i.e. a set of connecting cables departs from the central unit, each of which cables reaches a respective device (for example thread guide group, a mobile cam device, a stitch-regulating cam, etc.). In the present invention, on the contrary, the control of the feeders is serialized and performed "vertically": each feeder is managed by its own electronic command board, and all the boards are serially united in a serial control ring which connects the boards to the central unit of the knitting machine.

From a pneumatic point of view too, the present invention describes a knitting machine having a profoundly different configuration to those of the prior art. In fact, by positioning the solenoid valves at the respective pneumatic actuators (i.e. locating the solenoid valves which command the actuators of the feeders directly on the body of the thread guide group and the solenoid valves controlling the needle control cams directly on the body of the mobile cam device) it is possible to serialise the pneumatic supply part, realizing a single pneumatic supply pathway having a circular or ring conformation. In fact, the presence for each device integrating a pneumatic part of the respective solenoid valves enables eliminating the single pneumatic conduits which, in the prior art, connect each solenoid valve located in the command board point-to-point with the respective pneumatic actuator, and enables carrying compressed air directly to the single thread-feeders, where the solenoid valves activate—in place—all the pneumatic actuators of the feeder.

The invention as it is conceived is susceptible to numerous modifications and variants, all falling within the scope of the inventive concept, and the cited components can be replaced by others that are technically equivalent.

The present invention can be used on both new machines and already-existing machines, in the latter case in replacement for the pneumatic supply and control parts of the feeders of traditional type.

The invention attains important advantages. Primarily the whole invention enables overcoming some of the drawbacks of the prior art.

Further, the present invention leads to a reduction in the number of pneumatic tubes and/or electric cables present on the knitting head.

Further, the present invention enables a reduction in the time required for mounting the knitting machines and a simplification of the pneumatic cabling operations of the feeders.

Further, the present invention enables reducing the costs of manufacture of a circular knitting machine. Further, the present invention enables reducing the risks of mounting errors of the knitting machine. Further, the present invention enables a simplification of the maintenance operations of the machine, and in general improves accessibility of the knitting head and the devices thereof.

Further, the present invention enables reducing breakdowns and malfunctioning of the knitting machine and/or guarantees a greater efficiency over time, as the presence of pneumatic tubes and/or electric cables is limited.

Further, the present invention enables improving the performance of a knitting machine, as by delocalising the solenoid valves from the central unit to the respective thread-feeder (directly placing them on the respective device) it is possible to more rapidly control the pneumatic actuators, and therefore carry out the knitting work at higher speeds, in particular when a change of configuration of one or more of the thread guides is required.

Further, the serialisation of the pneumatic devices of the feeders described in the present invention enables making the structure of the dial group modular: the addition or removal of a thread guide can be carried out simply and rapidly.

Further, the present invention enables increasing the control of a knitting machine and/or increasing the versatility of use of the knitting machine for different production requirements. Further, the knitting machine of the present invention is characterised by a competitive cost and a simple and rational structure.

The invention claimed is:

1. A circular knitting machine (1) for knitwear or hosiery, comprising:

a bearing structure (2);

at least a needle cylinder (C) rotatably mounted in the bearing structure;

a plurality of needles supported by the needle cylinder (C) and mobile parallel to a rotation axis of the needle cylinder so as to produce a knitted fabric;

a plurality of feeders (3), wherein the thread is supplied to the needles of the machine, the feeders being positioned circumferentially about the needle-bearing organ and distanced angularly to one another;

wherein each feeder comprises at least:

a thread guide group (4) for feeding thread to the plurality of needles, comprising a body (5) of the thread guide group, an inlet (6) for pneumatic supply, a plurality of thread guides, arranged laterally to the needle cylinder (C) at the respective feeder, and a plurality of pneumatic actuators movably housed in the body of the thread guide group and configured so as to controlledly move the plurality of thread guides, the thread guide group comprising a plurality of solenoid valves (8) mounted and connected directly to the body (5) of the thread guide group, each solenoid valve (8) being configured and predisposed to activate or deactivate the pneumatic supply to a respective pneumatic actuator of the thread guide group (4), in order to selectively actuate the respective actuator;

a mobile cam device (10) for control of the needles, comprising a respective body (11) of the mobile cam device, a respective pneumatic supply inlet (12), one or more command cams (13) movably mounted to the body (11) and able to interact with the needles, and a respective plurality of pneumatic actuators movably housed in the body (11) and configured to controlledly move the one or more command cams, the mobile cam device comprising a respective plurality of solenoid valves (14) mounted and connected directly to the body (11) of the mobile cam device (10), each solenoid valve (14) being configured and predisposed to activate or deactivate the pneumatic supply of a respective pneumatic actuator of the device, in order to selectively actuate the respective actuator;

an electronic feeder command board (20), for example located on the thread guide group (4), configured and predisposed to command at least the solenoid valves (8) of the thread guide group (4) and the solenoid valves (14) of the mobile cam device (10), in order to selectively actuate the pneumatic actuators of the thread guide group (4) and the pneumatic actuators of the mobile cam device (10);

the knitting machine (1) further comprising at least a pneumatic supply pathway (50) able to supply the pneumatic actuators of the plurality of feeders (3) of the machine.

2. The knitting machine (1) of claim 1, comprising exactly a single serial pneumatic supply pathway (50) developing annularly about the rotation axis of the cylinder (C), the single pneumatic supply pathway comprising a pneumatic conduit or a sequence of sections of pneumatic conduit connecting, in series, all the feeders (3) of the knitting machine, in such a way that along the pneumatic supply pathway each feeder is pneumatically connected to the preceding feeder and to the following feeder.

3. The knitting machine (1) of claim 2, wherein the sequence of sections of conduit of the single pneumatic supply pathway (50) of the knitting machine comprises a plurality of connecting conduits (51) between distinct feeders (3) and a plurality of internal conduits (52) in each feeder, arranged in series that are alternated with one another, in which each connecting conduit (51) is interposed and shared, between two adjacent feeders (3), connecting a pneumatic supply outlet (9) of the thread guide group (4) of a preceding feeder with the pneumatic supply inlet (12) of the mobile cam device (10) of the following feeder, or vice versa, and in which each internal conduit (52) connects a pneumatic supply outlet (15) of the mobile cam device (10) of a respective feeder (3) with the respective pneumatic supply inlet (6) of the thread guide group (4) of the same feeder (3), each internal conduit being comprised in the feeder, or vice versa, in which overall the connecting conduits (51) and internal conduits (52) connect in sequence, alternating with one another, the thread guide group and the mobile cam devices of the plurality of feeders (3), realizing the single pneumatic supply pathway (50) of the machine.

4. The knitting machine (1) of claim 2, wherein the pneumatic conduit or the sequence of sections of pneumatic conduit connect, in series with one another, all the thread guide groups (4) of the feeders (3) and wherein the sequence of sections of the single pneumatic supply pathway of the machine further comprises a plurality of branching conduits (53) internal of each feeder (3) and each connecting a secondary pneumatic supply outlet (54) of the thread guide group (4) of a respective feeder with the respective pneumatic supply inlet (12) of the mobile cam device (10) of the same feeder (3), or vice versa wherein the pneumatic conduit or the sequence of sections of pneumatic sections connect in series all the mobile cam devices (10) of the feeders (3) and wherein the sequence of sections of the single pneumatic supply pathway of the machine further comprises a plurality of branching conduits (53) internal of each feeder and each connecting a secondary pneumatic supply outlet (54) of the mobile cam device (10) of a respective feeder with the respective pneumatic supply inlet (6) of the thread guide group (4) of the same feeder (3).

5. The knitting machine (1) of claim 1, wherein the at least an electronic command board (20) of each feeder (3) is configured and predisposed to command all of the solenoid valves (8, 14) present internally of the feeder (3), with the aim of selectively actuating all the pneumatic actuators of the feeder (3), and/or wherein each feeder (3) of the knitting machine comprises a single electronic command board (20) and/or wherein the knitting machine comprises a single electronic command board (20) for each feeder (3) or wherein the machine comprises a plurality of the electronic boards, each of which is configured and predisposed to command at least the solenoid valves (8) of the thread guide group (4) and the solenoid valves (14) of the mobile cam device (10) of at least two feeders, and/or wherein the electronic command board (20) of each feeder (3) is positioned on the respective thread guide group (4) of the feeder or on the respective mobile cam device (10) of the feeder, and/or wherein the knitting machine (1) comprises a compressed air source to which the at least a pneumatic supply pathway is connected so as to receive therefrom a compressed air flow.

6. The knitting machine (1) of claim 1, provided with a first serial pneumatic supply pathway (61), developing annularly about the rotation axis of the cylinder, comprising a pneumatic conduit or a sequence of sections (61*a*) of pneumatic conduit connecting, in series, the thread guide groups (4) of all the feeders (3) of the knitting machine, in such a way that along the first pneumatic supply pathway each thread guide group (4) is pneumatically connected with the preceding thread guide group and with the successive thread guide group, and wherein the knitting machine comprises a second serial pneumatic supply pathway (62), developing annularly about the rotation axis of the cylinder, comprising a respective pneumatic conduit or a respective sequence of sections (62*a*) of pneumatic conduit connecting, in series, the mobile cam devices (10) of all the feeders (3) of the knitting machine, in such a way that along the second pneumatic supply pathway each mobile cam device (10) is connected pneumatically with the preceding mobile cam device and with the successive mobile cam device.

7. The knitting machine of claim 1, comprising a plurality of pneumatic supply pathways (80) for the feeders, in a reciprocally parallel arrangement, equal in number to the plurality of feeders (3) of the machine, each pneumatic supply pathway to the feeder (3) being configured and predisposed to receive a compressed air flow from a source (S) of compressed air of the machine and to supply, with the compressed air flow, the pneumatic actuators present internally of a respective feeder (3), and/or wherein each pneumatic supply pathway to the feeders comprises a connecting conduit (81) connecting the compressed air source with the pneumatic supply inlet of the thread guide group of the respective feeder supplied by the supply pathway, and at least an conduit (82) intern of the feeder, connecting a pneumatic outlet of the thread guide group with the pneumatic supply inlet of the mobile cam device of the same feeder.

8. The knitting machine (1) of claim 1, wherein each feeder (3) of the knitting machine further comprises at least a respective knitting stitch regulating cam (30), operatively active on the needles and selectively and individually mobile so as to vary a size of the stitches produced by the needles at the respective feeder (3), the stitch regulating cam (30) comprising a respective actuator (31), preferably a step motor, configured so as to enable a controlled movement, and wherein, for each feeder (3), the respective electronic command board (20) of the feeder is configured and predisposed to activate and command the functioning of the stitch regulating cam, in particular the respective actuator.

9. The knitting machine (1) of claim 1, wherein each feeder of the knitting machine further comprises at least a needle selecting device (40), provided with a plurality of actuators individually activatable so as to act on a plurality of selectors, each located inferiorly of a respective needle of the plurality of needles of the knitting machine, so that the selectors position the respective needle between a plurality of operating configurations, and wherein, for each feeder, the respective electronic command board (20) of the feeder is configured and predisposed to control the functioning of the respective needle selecting device.

10. The knitting machine (1) of claim 1, provided with a serial control ring of the feeders, comprising a sequence of sections of electric cables connecting, in series, all the feeders of the knitting machine, in such a way that each feeder is electrically and/or electronically connected to the preceding feeder and with the successive feeder, the control ring constituting a shared serial communication channel between the feeders (3), by means of which electrical supply and control signals can be sent to each feeder, and/or or wherein the knitting machine comprises a central processing unit, to which the electronic command boards of the feeders are operatively connected, the central processing unit being configured so as to manage the functioning of the knitting machine and so as to send to the electronic command boards (20) of the feeders (3) a set of command instructions, and/or wherein the serial control ring of the feeders is connected, at least in a point thereof, to the central processing unit, so as to receive therefrom electric supply and control signals and so as to send thereto a plurality of data relating to the devices comprised in each feeder.

* * * * *